US009638150B2

(12) United States Patent
Umaoka

(10) Patent No.: US 9,638,150 B2
(45) Date of Patent: May 2, 2017

(54) OUTBOARD MOTOR

(71) Applicant: SUZUKI MOTOR CORPORATION, Hamamatsu-shi, Shizuoka (JP)

(72) Inventor: Seiichiro Umaoka, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/041,711

(22) Filed: Feb. 11, 2016

(65) Prior Publication Data

US 2016/0288890 A1 Oct. 6, 2016

(30) Foreign Application Priority Data

Apr. 6, 2015 (JP) ..... 2015-077324

(51) Int. Cl.
*B63H 20/32* (2006.01)
*F02M 35/16* (2006.01)

(52) U.S. Cl.
CPC ..... *F02M 35/167* (2013.01); *B63H 20/32* (2013.01)

(58) Field of Classification Search
CPC ..... B63H 20/32; F02M 35/167
See application file for complete search history.

(56) References Cited

U.S. PATENT DOCUMENTS 6,413,131 B1 * 7/2002 Phillips ..... F02B 61/045 123/198 E
6,932,662 B1 * 8/2005 Walczak ..... B63H 20/32 440/77
7,401,598 B2 * 7/2008 Ochiai ..... F02M 37/20 123/516

FOREIGN PATENT DOCUMENTS

JP H 7-71223 A 3/1995

* cited by examiner

*Primary Examiner* — Stephen Avila
(74) *Attorney, Agent, or Firm* — Stein IP, LLC

(57) ABSTRACT

An outboard motor includes an engine cover including an upper cover and a lower cover which form an engine room and which can be separated from each other vertically, the lower cover has a bottom wall and a circumferential wall which extends upward from an outer circumference of the bottom wall, an external air inlet through which to introduce air into the engine room is provided adjacent to the outer circumference of the bottom wall, and an inside wall extends upward from the bottom wall alongside the circumferential wall so as to be opposed to the circumferential wall with the external air inlet interposed between the inside wall and the circumferential wall.

5 Claims, 8 Drawing Sheets

OUTBOARD MOTOR

CROSS-REFERENCE TO RELATED APPLICATIONS

This application claims the benefit of Japanese Patent Application JP 2015-077324, filed Apr. 6, 2015, the entire content of which is hereby incorporated by reference, the same as if set forth at length.

FIELD OF THE INVENTION

The present invention relates to an outboard motor and, more particularly, to an outboard motor that is equipped with a ventilation device for ventilating an engine room.

BACKGROUND OF THE INVENTION

In outboard motors, the engine is covered with an engine cover that is composed of an upper cover and a lower cover. An external air inlet and a discharge outlet are formed in the engine cover, and the inside of the engine cover (e.g., engine room) is ventilated by driving a ventilation fan that is attached to the end of a crank shaft.

Since the engine cover is formed by injection-molding synthetic resin, in the case where the external air inlet, the discharge outlet, a duct for ventilation, etc. are formed in the upper cover, bosses and ribs need to be formed in the upper cover. In this case, a molded upper cover is complex in shape, as a result of which shrinkage cavities are prone to occur due to thermal contraction during molding. This is particularly problematic in the case of the upper cover because it is a component that influences the appearance of the outboard motor. In view of this problem, an outboard motor has been proposed in which an external air inlet and a discharge outlet are formed in a lower cover that is less influential to the appearance than an upper cover (refer to JP-A-7-71223, for example).

SUMMARY OF THE INVENTION

However, in the outboard motor disclosed in JP-A-7-71223, a flow passage from the external air inlet to the engine cover is formed by only a cylindrical member that extends vertically from an opening formed in a bottom wall of the lower cover. This raises a problem that water easily enters an engine case.

The present invention has been made in the above circumstances, and an object of the invention is therefore to provide an outboard motor capable of preventing entrance of water into the engine cover without affecting its appearance.

An outboard motor of the present invention has an engine cover which forms an engine room by an upper cover and a lower cover which can be separated from each other vertically, characterized in: that the lower cover has a bottom wall and a circumferential wall which extends upward from an outer circumference of the bottom wall; that an external air inlet through which to introduce air into the engine room is formed adjacent to the outer circumference of the bottom wall; and that an inside wall extends upward from the bottom wall alongside the circumferential wall so as to be opposed to the circumferential wall with the external air inlet interposed between itself and the circumferential wall.

With this configuration, an external air introduction path for guiding, into the engine room, air that is introduced through the external air inlet is formed as a space between the side wall and the inside wall. Since the lower cover is provided with the external air inlet and the external air introduction passage in this manner, no members for ventilating the engine room need to be provided in the upper cover. Therefore, the configuration of the upper cover is simplified to prevent deterioration of its appearance. Furthermore, since the external air introduction passage extends upward alongside the circumferential wall, a long distance can be secured between the external air inlet and the engine room. Therefore, even if air containing water enters the external air introduction passage, entrance of water into the engine room can be prevented.

Further, in the outboard motor of the present invention, it is preferable that a slant wall projects up outward from the top end of the inside wall so as to come closer to the associated side wall as the position goes up. With this feature, the exit of the external air introduction passage is narrowed by the slant wall which is formed between the circumferential wall and the inside wall. Therefore, even if air containing water enters the external air introduction passage, the water can be separated from the air as the air collides with the slant wall, which is also effective at preventing entrance of water into the engine room.

Further, in the outboard motor of the present invention, it is preferable that a projection wall extends downward from the bottom wall below the external air inlet. With this feature, since the projection wall is formed, a certain distance can be secured between the bottom end surface of the projection wall and the external air inlet and the external air introduction passage can be elongated accordingly. Therefore, even if air containing water that is splashed to reach the external air inlet and its neighborhood comes into the external air introduction passage, the water is separated from the air as the air flows through the external air introduction passage. As a result, the water is prevented from entering the engine room through the external air inlet.

Further, in the outboard motor of the present invention, it is preferable that the external air inlet is formed in a rear portion of the bottom wall so as to extend alongside the circumferential wall. With this feature, since the external air inlet is formed on the rear side in the lower cover so as to extend alongside the circumferential wall, a rear dead space of the lower cover can be utilized as the external air introduction passage.

Further, in the outboard motor of the present invention, it is preferable that the projection wall is part of a carrying handle that is disposed in the rear of the lower cover. With this feature, since the projection wall is part of the carrying handle, the carrying handle is given, in addition to its original function, a function of preventing entrance of water through the external air inlet. Therefore, it is not necessary to provide a separate component for preventing entrance of water through the external air inlet.

The outboard according to the invention can prevent entrance of water into the engine cover without affecting its appearance.

DESCRIPTION OF SYMBOLS

Figure 1:
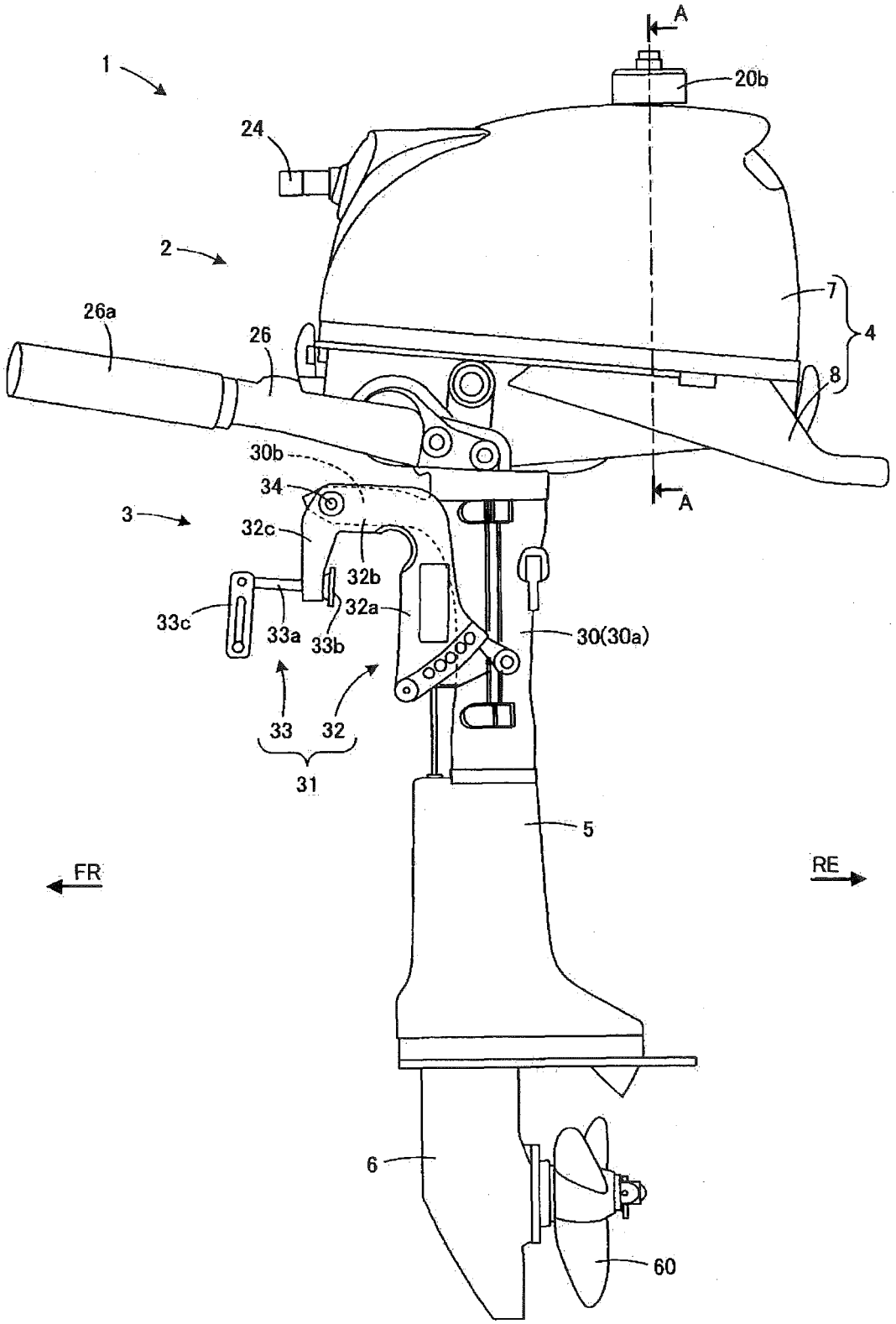
FIG. 1 is a side view of an outboard motor according to the embodiment.

1: Outboard motor
20: Fuel tank
21: Ventilation fan
22: Fan cover
22*c*: Air inlets
22*d*: Air outlet
3: Bracket device (attachment member)
30*b*: Horizontal portion (attachment member)
4: Engine cover
40: Engine room
46: Cylinder
47: Crank room
7: Upper cover
8: Lower cover
80: Bottom wall
80*a*: External air inlets
81: Circumferential wall
82: Discharge outlet
86: Inside wall
88: Slant wall
89: Projection wall

DETAILED DESCRIPTION OF THE INVENTION

Figure 2:
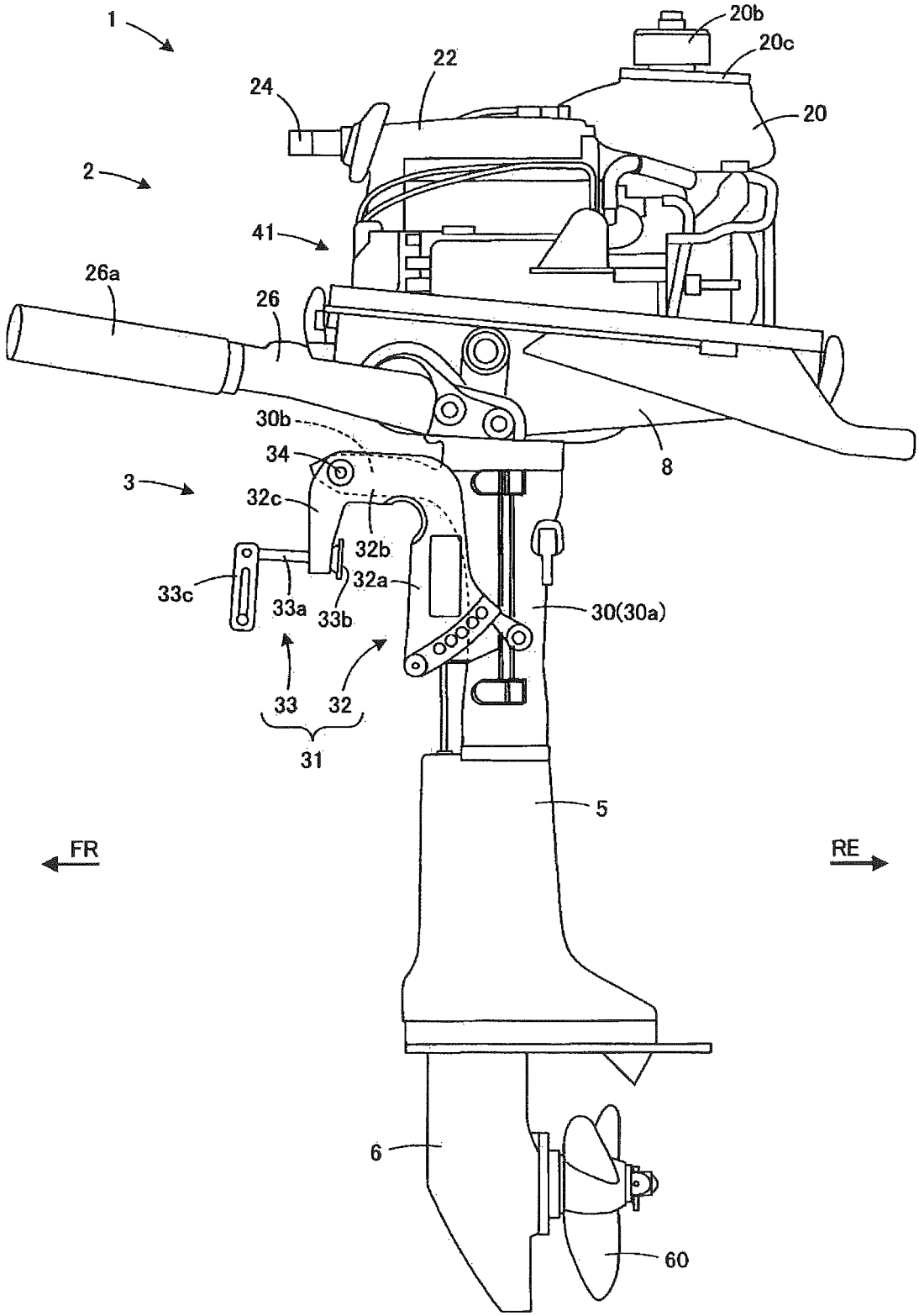
FIG. 2 is a side view of the outboard motor according to the embodiment without an upper cover.
Figure 3:
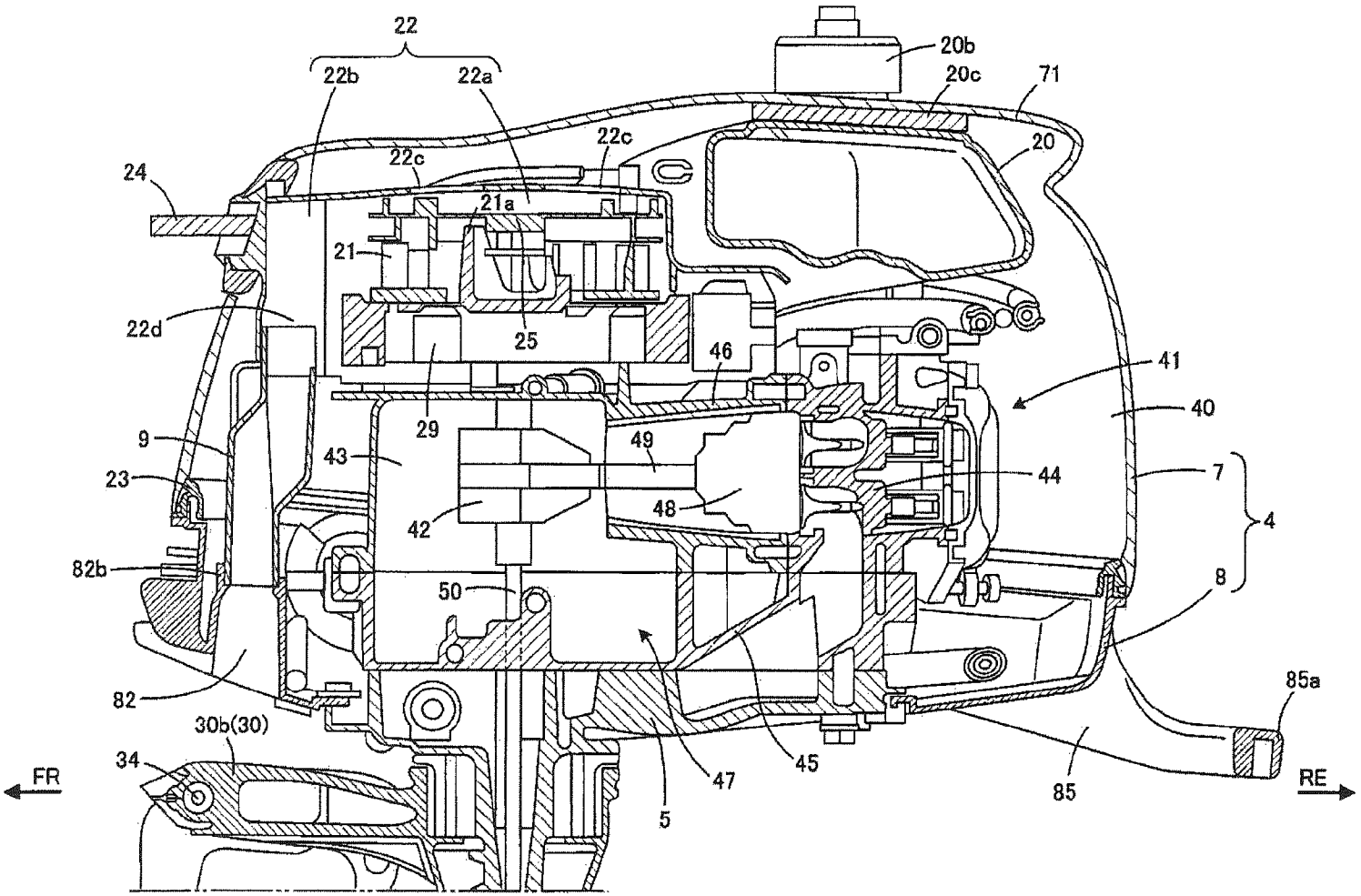
FIG. 3 is a vertical sectional view of an engine room and its neighborhood of the outboard motor according to the embodiment.

A general configuration of an outboard motor 1 according to an embodiment will be described below with reference to FIGS. 1-6. FIG. 1 is a side view of the outboard motor 1 according to the embodiment. FIG. 2 is a side view of the outboard motor 1 without an upper cover 7. FIG. 3 is a vertical sectional view of an engine room 40 and its neighborhood of the outboard motor 1. In the drawings, for convenience of description, the front side, the rear side, the left side, and the right side of the outboard motor 1 are indicated by arrows FR, RE, L, and R, respectively.

As shown in FIGS. 1 and 2, the outboard motor 1 according to the embodiment is of a medium or small size and includes an outboard motor main body 2 and a bracket device 3 for attachment of the outboard motor main body 2 to the stern (not shown) of a ship body. The outboard motor main body 2 has an engine cover 4 which is disposed at the top of the outboard motor main body 2, a drive shaft housing 5 which extends downward from the engine cover 4, and a gear case 6 which is attached to the bottom end of the drive shaft housing 5.

Figure 5B:
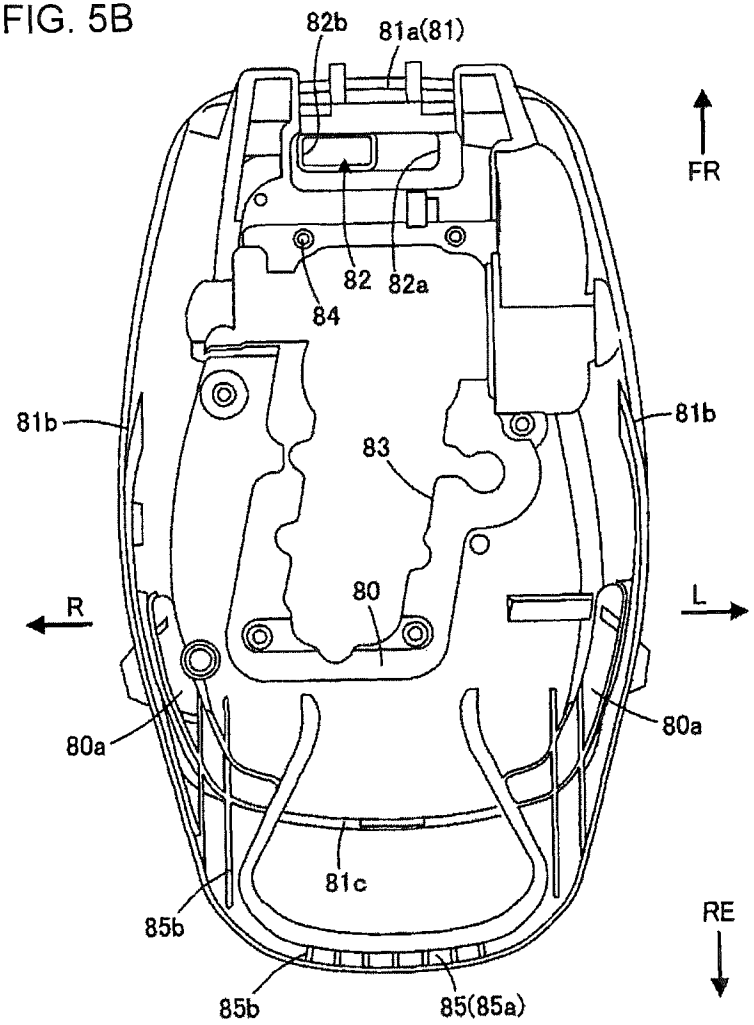
FIGS. 5A and 5B are a top view and a bottom view, respectively, of a lower cover used in the embodiment.
Figure 5A:
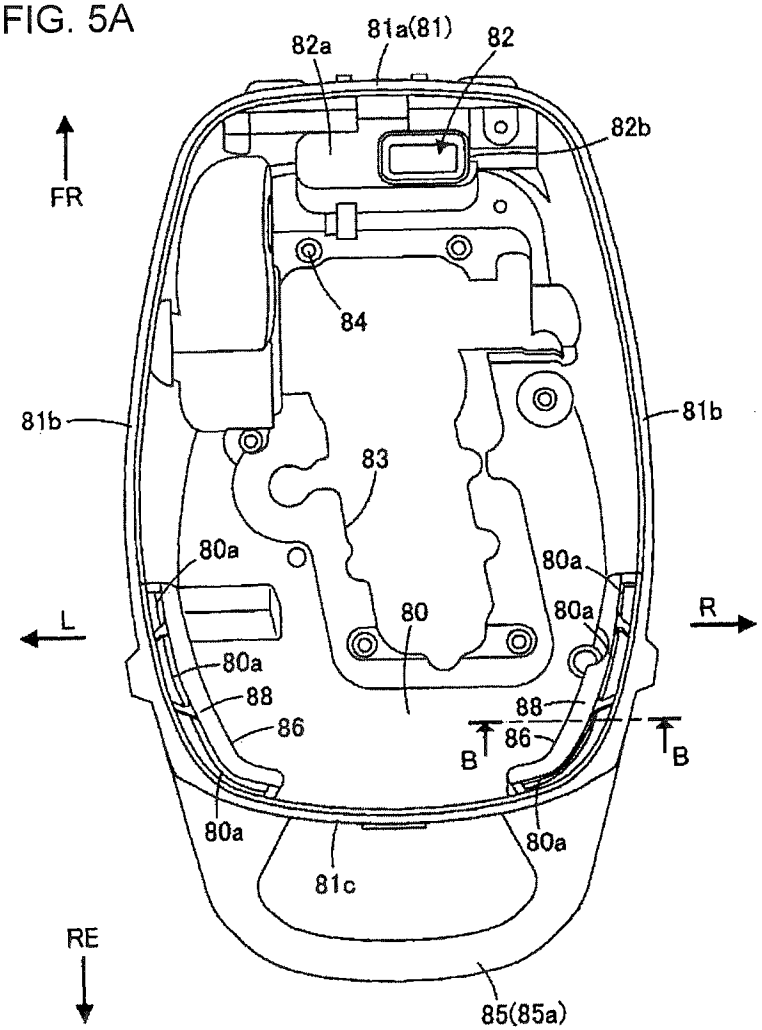

The engine cover 4 is composed of an upper cover 7 and a lower cover 8 which can be separated from each other in the vertical direction. The upper cover 7 is roughly shaped like a box that is open at the bottom. On the other hand, the lower cover 8 is roughly shaped like a box that is open at the top. As shown in FIGS. 5A and 5B, as described later in detail, the lower cover 8 is formed with external air inlets 80*a* for taking in external air and a discharge outlet 82 for discharging air that has circulated inside the engine cover 4. The detailed configurations of the upper cover 7 and the lower cover 8 will be described later in detail. By combining the upper cover 7 and the lower cover 8 together, an engine room 40 (see FIG. 3) is formed as an inside space of the engine cover 4. The engine room 40 houses various components such as an engine 41 and a fuel tank 20.

As shown in FIG. 2, approximately a bottom half of the engine 41 is housed in the lower cover 8 and a fan cover 22 which covers a ventilation fan 21 (see FIG. 3) and other components is disposed above the engine 41. The fuel tank 20 is disposed in the rear of the fan cover 22. As shown in FIG. 3, a ring-shaped sealing member 23 is disposed between the mating surfaces of the upper cover 7 and the lower cover 8. Made of an elastic material such as rubber, the sealing member 23 prevents entrance of water such as sea water through between their mating surfaces.

A recoil starter lever 24 for starting the engine 41 projects forward from the outboard motor 1 through the upper cover 7. A starter rope (not shown) is connected to the lever 24 and wound around a recoil starter pulley 25 (see FIG. 3), which is linked to a crank shaft 42 (see FIG. 3) of the engine 41 coaxially with it. When the lever 24 is pulled, the crank shaft 42 is rotated forcibly and the engine 41 is started.

A tiller handle 26 extends forward from the outboard motor 1, more specifically, from the lower cover 8. The tiller handle 26 is configured so as to be swingable vertically with a front-left portion of the lower cover 8 as a support point. A throttle grip 26*a* is attached to a tip portion of the tiller handle 26. The throttle grip 26*a* is configured so as to be rotatable about the axis of the tiller handle 26. The suction rate of an air-fuel mixture that is sucked into the combustion room from a carburetor 27 (see FIG. 7) according to a rotation angle of the throttle grip 26*a*, whereby the speed and the acceleration of the ship can be controlled.

The drive shaft housing 5 is formed so as to extend downward (vertically) from a portion, a little in front of the center, of the lower cover 8. The drive shaft housing 5 houses a drive shaft 50 (see FIG. 3) which extends vertically. The drive shaft 50 has a role of transmitting rotational power of the crank shaft 42 (see FIG. 3) of the engine 41 to a propeller 60.

The gear case 6 houses gears (not shown) for converting rotational power of the drive shaft 50 into rotational power of the propeller 60 and a propeller shaft (not shown). The propeller shaft extends rearward (horizontally) from a bottom end portion of the drive shaft 50, and the propeller 60 is attached to a rear end portion of the propeller shaft. Drive power of the engine 41 is converted into rotational power of the propeller 60 by the drive shaft 50, the propeller shaft, etc., whereby the outboard motor 1 acquires propulsion.

The bracket device 3 is composed of a swivel bracket 30 which supports the outboard motor main body 2 and a clamp bracket 31 to be fixed to the stern of a ship body. The swivel bracket 30 is attached to the clamp bracket 31 so as to be swingable vertically. The swivel bracket 30 has a cylindrical portion 30*a* which extends vertically and a horizontal portion 30*b* which extends forward (horizontally) from a top end portion of the cylindrical portion 30*a* (see FIGS. 2 and 3). The cylindrical portion 30*a* of the swivel bracket 30 is attached to the outboard motor main body 2 so as to cover approximately a top half of the drive shaft housing 5, whereby the swivel bracket 30 supports the outboard motor main body 2. A tip portion of the horizontal portion 30*b* serves as a swing support point of the outboard motor main body 2.

The clamp bracket 31 is composed of a bracket portion 32 having an inverted-U shape in a side view and a clamp portion 33 for clamping a ship body. The bracket portion 32 has a vertical portion 32*a* which extends vertically, a horizontal portion 32*b* which extends forward (horizontally) from a top portion of the vertical portion 32*a*, and a projection portion 32*c* which projects downward (vertically) from a tip portion of the horizontal portion 32*b*. The vertical portion 32*a* and the projection portion 32*c* are opposed to each other with a prescribed gap.

The clamp portion 33 is configured in such a manner that a circular plate 33*b* is attached to a tip portion of a bolt 33*a* and a lever 33*c* is attached to a base portion of the bolt 33*a*. The bolt 33*a* is threadedly engaged with the projection portion 32*c* horizontally so that the plate 33*b* is located between the projection portion 32*c* and the vertical portion 32*a* of the bracket portion 32. A portion of the stern of a ship body is held between the plate 33*b* and the vertical portion 32*a* by inserting the portion of the stern between them and rotating the bolt 33*a*. In this manner, the outboard motor main body 2 can be attached to the ship body.

In the state of FIG. 1, the vertical portion 32*a* and the horizontal portion 32*b* of the bracket portion 32 extend along the cylindrical portion 30*a* and the horizontal portion 30*b* of the swivel bracket 30, respectively, and a tip portion of the horizontal portion 32*b* is connected swingably to a tip portion of the horizontal portion 30*b* by a pin 34. As a result, the angle of the outboard motor main body 2 with respect to the ship body can be adjusted.

Figure 7:
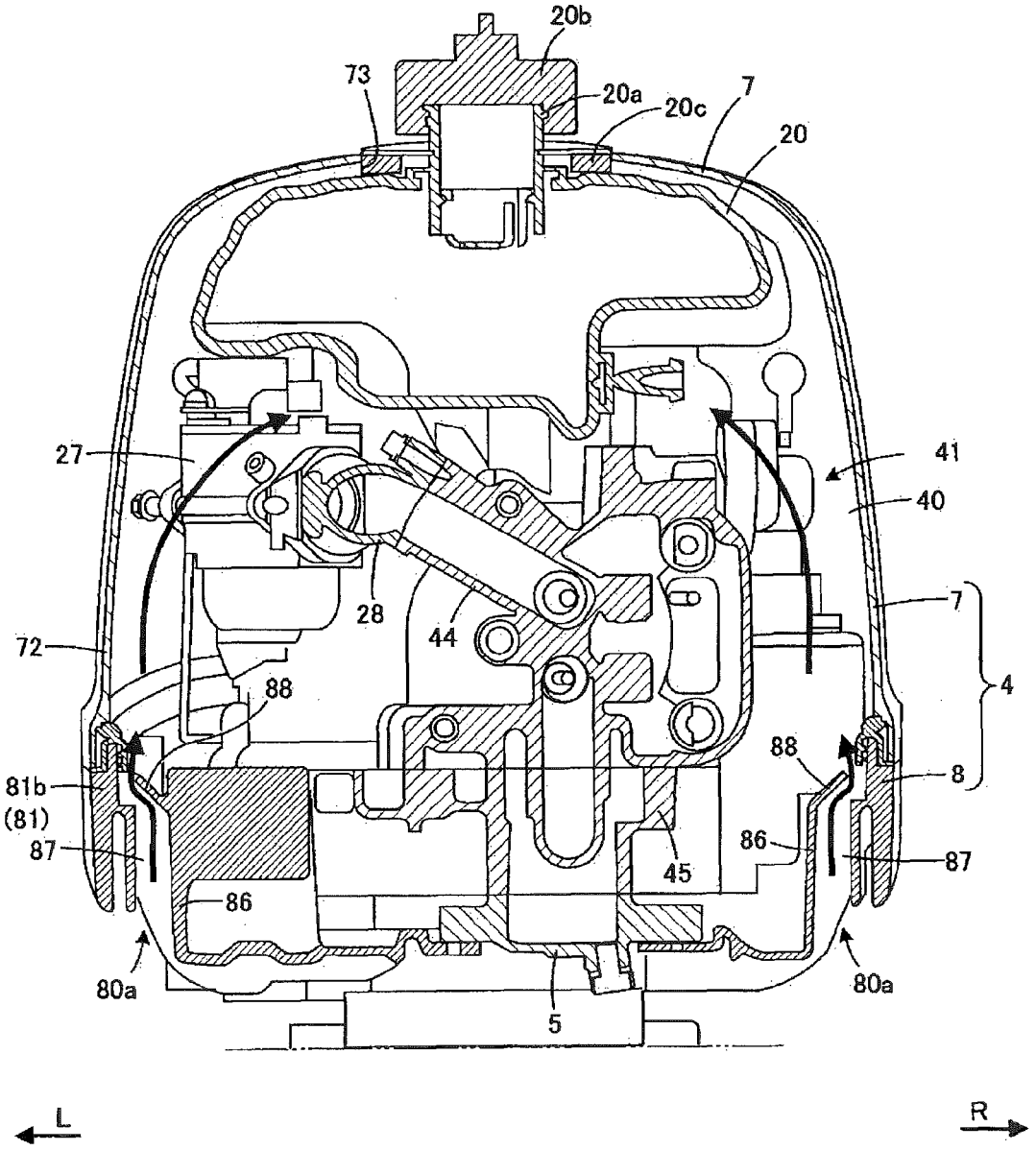
FIG. 7 is a sectional view taken along line A-A in FIG. 1 and shows air flow paths in the engine room of the outboard motor according to the embodiment.

Next, a detailed configuration inside the engine room 40 will be described with reference to FIG. 3. As shown in FIG. 3, the engine 41 includes a cylinder block 43, a cylinder head 44, and a crank case 45 and is disposed in such a manner that the axial direction of a cylinder 46 of the cylinder block 43 extends horizontally. The cylinder head 44 is attached to a rear portion of the cylinder block 43 and the crank case 45 is attached to a bottom portion of the cylinder block 43. The cylinder block 43 and the crank case 45 form a crank room 47, which occupies a front space of the engine room 40. As shown in FIG. 7, the carburetor 27 is connected to the cylinder head 44 via an intake manifold 28.

The crank shaft 42, whose axial direction is in the vertical direction, is disposed in the crank room 47, and the cylinder 46 houses a piston 48 so that it can reciprocate in the front-rear direction. A connecting rod 49 connects the crank shaft 42 and the piston 49. In the engine 41, the piston 48 reciprocates in the front-rear direction and the crank shaft 42 is thereby rotated via the connecting rod 49.

The above-mentioned drive shaft 50 is connected to a bottom end portion of the crank shaft 42 so as to be able to rotate together with it. A top end portion (not shown in FIG. 3) of the crank shaft 42 projects toward the top wall of the cylinder block 43. A flywheel magnet 29 is disposed over the cylinder block 43 and connected to the top end portion of the crank shaft 42 so as to be able to rotate together with it.

The ventilation fan 21 (ventilation device) is disposed on the top surface of the flywheel magnet 29. The ventilation fan 21 is composed of plural blades 21*a* which are erected from top surface of the flywheel magnet 29. The flywheel magnet 29 and the ventilation fan 21 are configured so as to be able to rotate together. The above-mentioned recoil starter pulley 25 is disposed above the ventilation fan 21. The fan cover 22 is disposed above the recoil starter pulley 25 so as to cover the flywheel magnet 29, the ventilation fan 21, and the recoil starter pulley 25.

The fan cover 22 is formed by injection molding, for example. The fan cover 22 is formed by connecting a fan housing portion 22*a* which houses the ventilation fan 21 and the recoil starter pulley 25 and a lever housing portion 22*b* which houses the lever 22*b*. The fan housing portion 22*a* is shaped like a box that is circular in a top view and is open at the bottom. The lever housing portion 22*b* is approximately shaped like a rectangular parallelepiped and projects forward from a portion of one side of the fan housing portion 22*a*.

Air inlet 22*c* through which air flows into the fan cover 22 from the engine room 40 are formed in the top wall of the fan housing portion 22*a*. The air inlets 22*c* are plural slits that extend radially from the center of the fan housing portion 22*a* in a top view. An air outlet 22*d* for discharging air out of the fan cover 22 is formed in the lever housing portion 22*b*. The air outlet 22*d* has a bottom opening at a position that is on the tip side in the lever housing portion 22*b* (i.e., on the front side in the engine room 40) and is opposed to the horizontal portion 30*b* of the swivel bracket 30.

A ventilation duct 9, which is part of a discharge path of the ventilation device, is disposed in the bottom-front of the fan cover 22. The ventilation duct 9 has a cylindrical shape that extends vertically. The top end of the ventilation duct 9 is connected to the air outlet 22*d*, and the bottom end of the ventilation duct 9 is connected to a discharge outlet 82 (cylindrical portion 82*b*) of the lower cover 8 (described later).

In the embodiment, the discharge outlet 82 of the lower cover 8 which is a fixed component of the outboard motor main body 2 including the engine 41 is connected to the air outlet 22*d* of the fan cover 22 by the ventilation duct 9. Therefore, in attaching the upper cover 7 to the lower cover 8, it is not necessary to visually recognize a positional relationship between the upper cover 7 and the fan cover 22. This prevents lowering of the efficiency of work of attaching the upper cover 7 to the lower cover 8.

The fuel tank 20 is disposed over the cylinder head 44 in the rear of the fan cover 22 so as to form a gap with each of the top surface of the cylinder head 44 (cylinder 46) and the fan cover 22. As shown in FIG. 7, the top wall of the fuel tank 20 is formed with a fuel filler opening 20*a* is formed and the fuel filler opening 20*a* projects upward past an opening 73 which is formed in the top wall of the upper cover 7. The fuel filler opening 20*a* is provided with a tank cap 20*b*.

A ring-shaped sealing member 20*c* is disposed on the top surface of the fuel tank 20 around the fuel filler opening 20*a*. The sealing member 20*c* is made of an elastic material such as rubber, and the top surface of the sealing member 20*c* is in contact with the bottom surface of a top wall 71 of the upper cover 7. This prevents water such as sea water from entering the engine room 40 through the opening 73 of the upper cover 7.

In the outboard motor 1 having the above configuration, when the engine 41 is driven, rotational power of the crank shaft 42 is converted into rotational power of the propeller 60 via the drive shaft 50 etc., whereby propulsion for the ship is obtained.

The rotation of the crank shaft 42 causes rotation of the flywheel magnet 29 and the ventilation fan 21. And the rotation of the ventilation fan 21 produces an air flow in the engine room 40. Air that has circulated through the engine room 40 is discharged through the discharge outlet 82 of the lower cover 8 via the fan cover 22 and the ventilation duct 9. The engine room 40 is ventilated in this manner.

Incidentally, in conventional outboard motors, fuel temperature increase etc. due to temperature increase in the engine room is a factor in obstructing increase of the output power of the outboard motor. In view of this, large-size outboard motors employ a structure for suppressing temperature increase in the engine room by ventilating it. With this measure, the engine room temperature is reduced and the output power of outboard motors is increased. On the other hand, in medium-size and small-size outboard motors, a structure for ventilation of the engine room has not been employed because of weight reduction, simplification of the configuration, cost reduction, and other factors.

However, in recent years, even in medium-size and small-size outboard motors, it has come to be desired to ventilate the engine room from the viewpoints of fuel efficiency etc. One method would be to form an external air inlet in the upper cover, as in large-size outboard motors. However, since the upper cover is formed by injection-molding synthetic resin, complicating the shape of the upper cover increases the probability of occurrence of molding failures. Furthermore, it is not very preferable in terms of appearance.

In view of the above, in the outboard motor 1 according to the embodiment, members for ventilating the engine room 40, such as the external air inlets 80*a* and the discharge outlet 82 (see FIGS. 5A and 5B), are concentrated in the lower cover 8 rather than the upper cover 7. This makes it possible to ventilate the engine room 40 without affecting the appearance.

Figure 4:
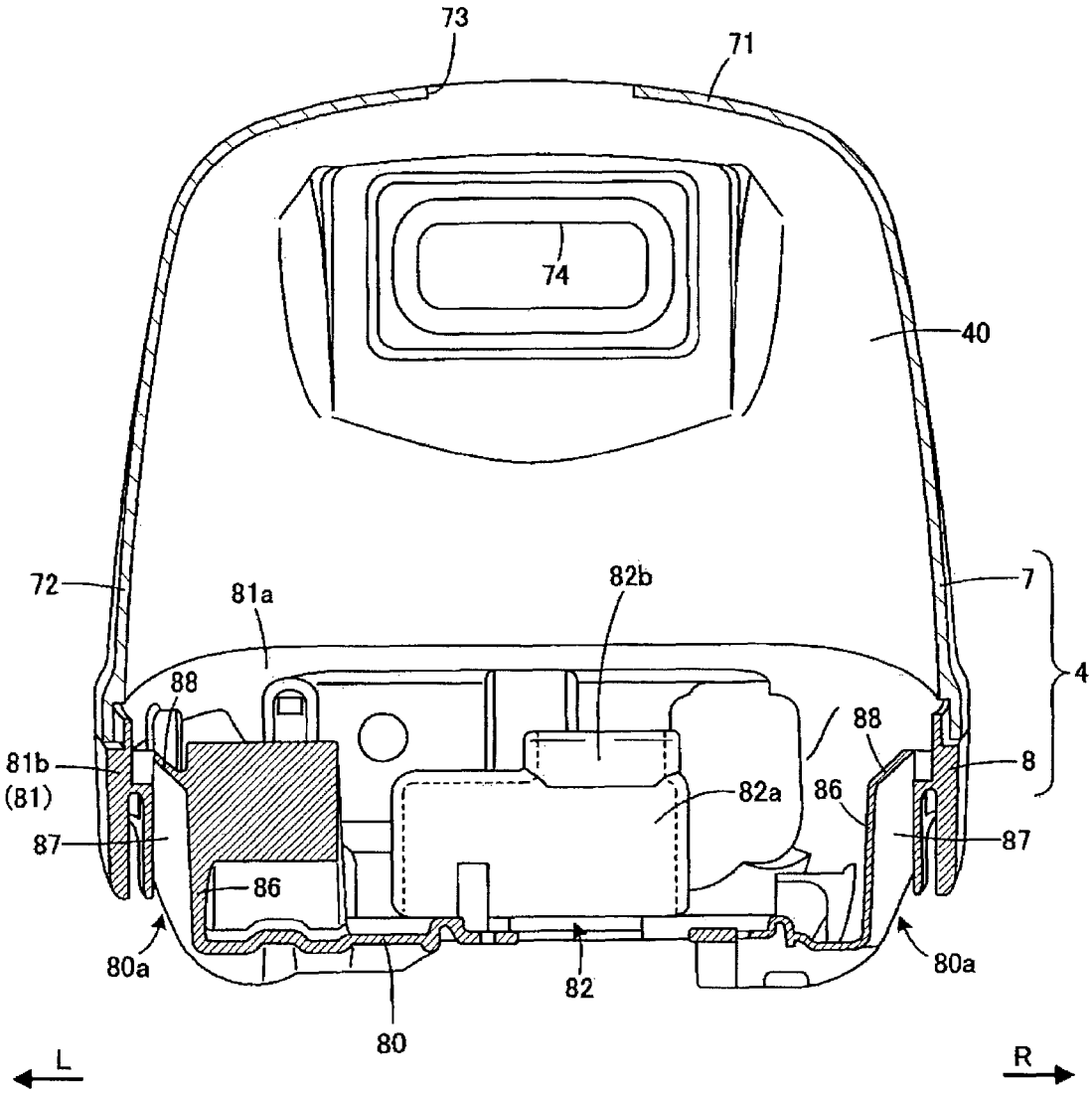
FIG. 4 is a sectional view, taken along line A-A in FIG. 1, of only the engine cover.

Next, a detailed configuration of the engine cover 4 (upper cover 7 and lower cover 8) used in the embodiment will be described. FIG. 4 is a sectional view, taken along line A-A in FIG. 1, of only the engine cover 4. FIGS. 5A and 5B are a top view and a bottom view of the lower cover 8 used in the embodiment, respectively.

As shown in FIGS. 3 and 4, the engine cover 4 is configured in such a manner that the engine room 40 is formed by the upper cover 7 and the lower cover 8. The upper cover 7 is shaped like a box that is open at the bottom and is formed so as to be able to be attached to and detached from the lower cover 8. The upper cover 7 has a top wall 71 and a cylindrical circumferential wall 72 which extends downward from the outer circumference of the top wall 71. As described above, the opening 73 for access to the fuel tank 20 is formed in the top wall 71 a little in the rear of its center. An opening 74 in which the lever 24 is to be inserted is formed in a top-front portion of the circumferential wall 72.

As shown in FIG. 3 to FIGS. 5A and 5B, the lower cover 8 is shaped like a box that is open at the top and the upper cover 7 is attached to the upper cover 7 via the ring-shaped sealing member 23 so as to close the opening of the upper cover 7. The lower cover 7 has a bottom wall 80 and a cylindrical circumferential wall 81 which extends downward from the outer circumference of the bottom wall 80. The circumferential wall 81 is formed by a front wall 81*a* which is rectangular in a front view, a pair of side walls 81*b* which extends rearward from the two respective ends of the front wall 81*a*, and a rear wall 81*c* which connects the rear ends of the pair of side walls 81*b* and is opposed to the front wall 81*a*.

The discharge outlet 82 for discharging air out of the engine room 40 is formed immediately inside the front wall 81*a* of the circumferential wall 81 of the lower cover 8 so as to be open at the bottom. The discharge outlet 82 is formed in such a manner that a box-shaped portion 82*a* which is erected upward from the opening formed in the bottom wall 80 and a cylindrical (rectangular cylinder) portion 82*b* which is erected upward from the top surface of the box-shaped portion 82*a* communicate with each other. In a top view, the box-shaped portion 82*a* assumes a rectangle that is long in the left-right direction. The cylindrical portion 82*b* is deviated from the box-shaped portion 82*a*, that is, formed on the top surface of approximately a right half of the box-shaped portion 82*a*. That is, the cylindrical portion 82*b* is disposed on the top surface of the box-shaped portion 82*a* on the side that is opposite to the left side in which the tiller handle 26 (see FIG. 1) is provided. As a result, a front-right space of the lower cover 8 can be utilized effectively.

The bottom end of the above-described ventilation duct 9 is connected to the cylindrical portion 82*b*. An opening 83 which is long in the front-rear direction is formed in the bottom wall 80 approximately at its center. Plural attachment holes 84 for attachment of the upper cover 7 to the above-described drive shaft housing 5 are formed around the opening 83.

A carrying handle 85 which allows a user to carry the outboard motor 1 (see FIG. 1) is disposed in the rear of the circumferential wall 81. The carrying handle 85 is configured in such a manner that two respective end portions of a grip 85*a* which is C-shaped in a top view are connected to the side walls 81*b* and the rear wall 81*c*. In a sectional view, the grip 85*a* has an inverted-U shape that is open at the bottom (see FIG. 3). And the pair of legs of the inverted-U shape project from the bottom surface of the bottom wall 80 (see FIG. 6). As is understood from a bottom view, to increase the rigidity of the carrying handle 85, each opening of the grip 85*a* is provided with plural ribs 85*b*.

The external air inlets 80*a* for introducing air into the lower cover 8 (i.e., engine room 40) are formed on the rear side in the lower cover 8 adjacent to the outer circumference of the bottom wall 80. The two external air inlets 80*a* extend alongside parts of the side walls 81*b*, respectively. Each external air inlet 80*a* has a long bottom opening that extends approximately in the front-rear direction.

The bottom wall 86 is formed with a pair of inside walls 86 which extend upward so as to be opposed to and extend alongside the respective side walls 81*b* with the respective external air inlets 80*a* interposed in between. Thus, the inside walls 86 are erected from the bottom wall 80 so as to be spaced from the respective side walls 81*b* by the width of the external air inlets 80*a*.

The spaces between side walls 81*b* and the inside walls 86 serve as respective external air introduction passages 87 that extend vertically. Since in this manner the external air inlets 80*a* are formed on the rear side in the lower cover 8 so as to extend alongside the circumferential wall 81 (i.e., side walls 81*b* and rear wall 81*c*), rear dead spaces of the lower cover 8 can be utilized as the external air introduction passages 87. In the embodiment, air that is introduced through the external air inlets 80*a* flows into the engine room 40 via the external air introduction passages 87.

A slant wall 88 projects from the top end of each inside wall 86 up outward, that is, so as to come closer to the associated side wall 81*b* as the position goes up. The slant wall 88 functions as a guide wall for causing air that is introduced through the external air inlet 80*a* to flow parallel with the associated side wall 81*b*.

Figure 6:
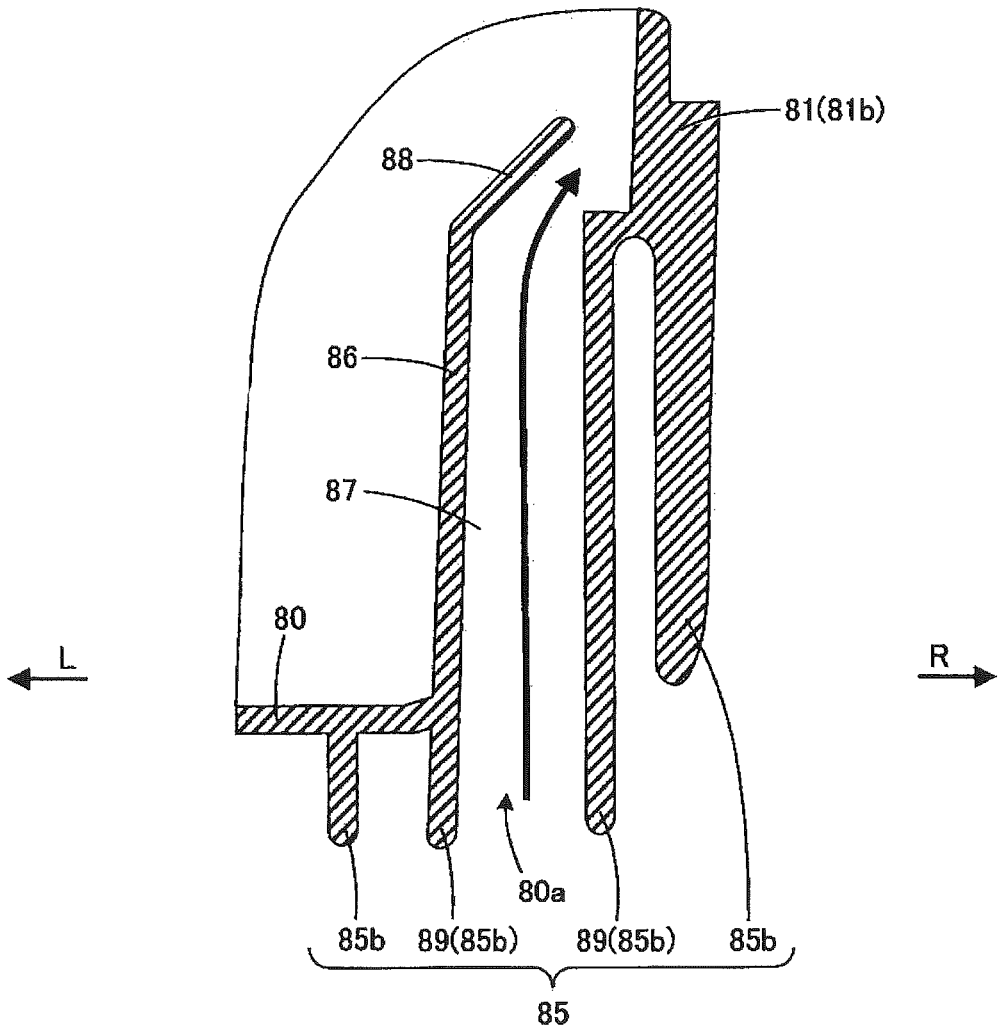
FIG. 6 is a schematic sectional view taken along line B-B in FIG. 5A.

Now, referring to FIG. 6, members located in the neighborhood of each external air inlet 80*a* of the lower cover 8 will be described in detail. FIG. 6 is a sectional view taken along line B-B in FIG. 5A.

As shown in FIG. 6, each inside wall 86 is erected from the bottom wall 80 at the position close to the connection portion of the bottom wall 80 and the associated side wall 81*b* of the circumferential wall 81 so as to extend alongside the side wall 81*b*. As described above, the external air inlet 80*a* that is open at the bottom is in the portion, located between the side wall 81*b* and the inside wall 86, of the bottom wall 80. And the space between the side wall 81*b* and the inside wall 86 serves as the external air introduction passage 87. As shown in FIG. 6, the portions of the inverted-U-shaped cross section of the grip 85*a* of the carrying handle 85 project downward from the bottom wall 80.

A projection wall 89 projects downward from the bottom wall 80 around the associated external air inlet 80*a*. The projection wall 89 is formed by part of the ribs 85*b* of the carrying handle 85 so as to go alongside the associated side wall 81*b* and inside wall 86.

In the lower cover 8 having the above configuration, air for ventilation is introduced into the engine room 40 through the external air inlets 80*a* which are formed in the bottom wall 80. Since as described above the projection walls 89 (ribs 85*b*) project downward from the bottom wall 80, a certain distance can be secured between the bottom ends of the projection walls 89 and the external air inlets 80*a* and the external air introduction passages 87 (i.e., the distance between bottom ends of the projection walls 89 and the top ends of the inside walls 86) can be elongated accordingly. Therefore, even if air containing water that is splashed to reach the external air inlets 80*a* and their neighborhoods comes into the external air introduction passages 87, the water is separated from the air as the air flows through the external air introduction passages 87. As a result, the water is prevented from entering the engine room 40 through the external air inlets 80*a*.

As described above, air containing water does not enter the engine room 40 directly through the external air inlets 80*a* and, instead, only water-separated air is taken into the engine room 40, whereby entrance of water into the engine room 40 can be prevented. Furthermore, since the projection walls 89 are part of the ribs 85*b* of the carrying handle 85, the ribs 85*b* provide the function of increasing the strength of the grip 85 (the original function of the carrying handle 85) as well as the function of preventing entrance of water through the external air inlets 80*a*. Therefore, it is not necessary to provide a separate component for preventing entrance of water through the external air inlets 80*a*.

Air that is taken in through the external air inlets 80*a* go up along the external air introduction passages 87. Since the external air introduction passages 87 extend vertically, a long distance can be secured between the bottom wall 80 (external air inlets 80*a*) and the engine room 40. Therefore, even if air containing water enters the external air introduction passages 87, the water that is heavier than the air is separated from the air halfway because of its own weight and then moves toward the bottom wall 80 (external air inlets 80*a*). The water is thus hard to enter the engine room 40.

At the top ends of the external air introduction passages 87 and their neighborhoods, air flows into the engine room 40 while colliding with the slant walls 88 and flowing alongside the side walls 81*b*. Thus, since the exits of the external air introduction passages 87 are narrowed by the slant walls 88, water contained in air can be separated from the air and captured, which is also effective at preventing entrance of water into the engine room 40.

As described above, in the embodiment, the members for ventilating the engine 41, such as the external air inlets 80*a* and the external air introduction passages 87, are concentrated in the lower cover 8 which is not very influential to the appearance. This makes it possible to ventilate the engine room 40 without affecting the appearance. As a result, the configuration of the upper cover 7 which is influential to the appearance can be simplified. In turn, the engine room 40 can be ventilated without the need for caring about occurrence of molding failures such as shrinkage cavities in the upper cover 7.

Figure 8:
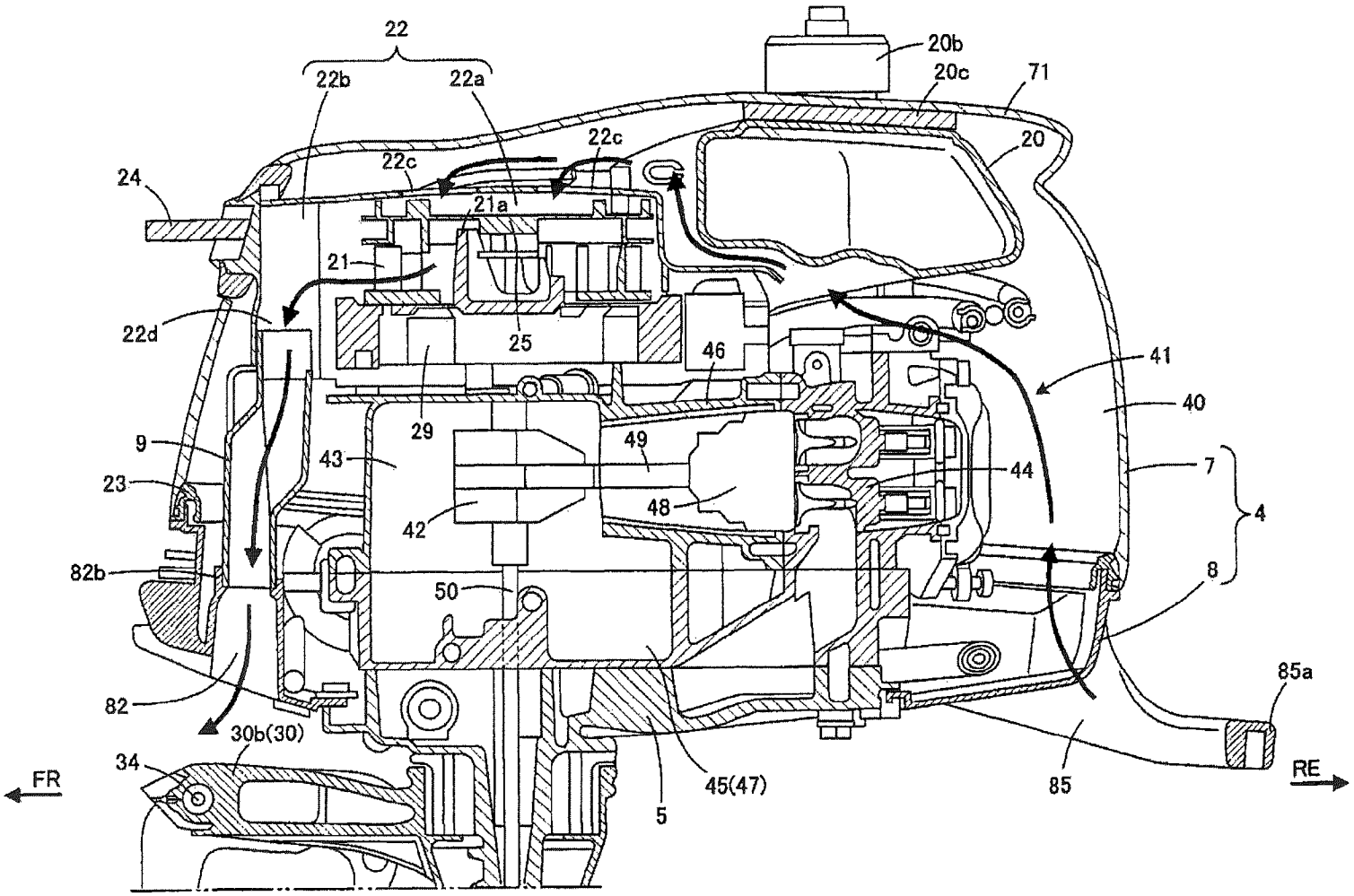
FIG. 8 is a vertical sectional view of an engine room and its neighborhood of the outboard motor according to the embodiment and shows air flow paths in its engine room.

Next, the ventilation paths in the engine room 40 will be described with reference to FIGS. 7 and 8. FIGS. 7 and 8 show air flow paths in the engine room 40 of the outboard motor 1 according to the embodiment. FIG. 7 is a sectional view taken along line A-A in FIG. 1. The following description assumes that the engine 41 is being driven and the ventilation fan 21 is being rotated, whereby air is flowing in the engine room 40.

As shown in FIGS. 7 and 8, air that is introduced through the external air inlets 80*a* of the lower cover 8 flows into the engine room 40 via the external air introduction passages 87. Inside the engine room 40, the air passes through the gaps between individual components and moves toward the ventilation fan 21. That is, as shown in FIG. 8, the air passes through the gap between the cylinder head 44 and the fuel tank 20 and the gap between the fuel tank 20 and the fan cover 22 and moves toward the top space of the engine room 40.

In the embodiment, since the fuel tank 20 is disposed in the rear of the air inlets 22*c* of the ventilation fan 21, the fuel tank 20 can be disposed close to the external air inlets 80*a* and air that is introduced through the external air inlets 80*a* can be caused to flow near the fuel tank 20. Therefore, temperature increase of the fuel tank 20 can be reduced to suppress evaporation of the fuel contained therein.

Furthermore, since the gap is formed between the cylinder head 44 (the outer surface of the cylinder 46) and the fuel tank 20, the fuel tank 20 can be spaced from the engine 41 which is a heat source. Therefore, no heat is transmitted directly from the engine 41 to the fuel tank 20. Since the gap between the cylinder head 44 (the outer surface of the cylinder 46) and the fuel tank 20 can be used as part of the air flow paths in the engine room 40, air directly hits the fuel tank 20 to enhance the effect of cooling it.

Since as mentioned above the ventilation fan 21 is rotating, air flows from above the fan cover 22 into the fan cover 22 (fan housing portion 22*a*) through the air inlets 22*c*. Inside the fan cover 22, a whirlwind is produced by the plural rotating blades 21*a*. Thus, air flows from the fan housing portion 22*a* into the outer circumferential space of the ventilation fan 21 and moves to the air outlet 22*d* via the lever housing portion 22*b*. Then the air passes through the air outlet 22*d* of the fan cover 22, flows down along the ventilation duct 9, and is discharged from the engine room 40 through the discharge outlet 82 of the lower cover 8.

Since the discharge outlet 82 has the bottom opening that is opposed to the horizontal portion 30*b* of the swivel bracket 30, when waves surge in to the outboard motor main body 2, the horizontal portion 30*b* stops sea water to prevent it from entering the engine room 40 directly through the discharge outlet 82. Furthermore, since the air discharge path from the air outlet 22*d* of the fan cover 22 to the discharge outlet 82 is elongated by the ventilation duct 9 in the vertical direction, a long distance can be secured between the discharge outlet 82 and the components of the engine 41. This is also effective at preventing entrance of sea water into the engine room 40.

Since the air outlet 22*d* and the discharge outlet 82 are disposed at front positions in the engine room 40 and the external air inlets 80*a* are disposed in the rear of the air inlets 22*c* in the engine room 40, the air flow paths from the external air inlets 80*a* to the discharge outlet 82 are formed so as to guide air from the rear side to the front side in the engine room 40. This allows air to reach a wide part of the engine room 40 and flow without stagnating.

As described above, in the outboard motor 1 according to the embodiment, the external air introduction passages 87 for guiding, into the engine room 40, air that is introduced through the external air inlets 80*a* are formed as spaces between the side walls 81*b* and the inside walls 86. Since the lower cover 8 is provided with the external air inlets 80*a* and the external air introduction passages 87 in this manner, no members for ventilating the engine room 40 need to be provided in the upper cover 7. Therefore, the configuration of the upper cover 7 is simplified to prevent deterioration of its appearance.

Furthermore, since the external air introduction passages 87 extend upward alongside the circumferential wall 81, a long distance can be secured between the external air inlets 80*a* and the engine room 40. Therefore, even if air containing water enters the external air introduction passages 87, entrance of water into the engine room 40 can be prevented.

The invention is not limited to the above embodiment and can be practiced by modifying it in various manners. The invention is not limited to the sizes, shapes, etc. shown in the accompanying drawings and they can be modified as appropriate within the confines that the advantages of the invention can be obtained. Other modifications can also be made as appropriate as long as the object of the invention is attained.

For example, although in the embodiment the air outlet 22*d* of the fan cover 22 is connected to the discharge outlet 82 of the lower cover 8 by the ventilation duct 9, the invention is not limited to this case; the air outlet 22*d* of the fan cover 22 may be connected to the discharge outlet 82 of the lower cover 8 directly, that is, without intervention of the ventilation duct 9.

Although in the embodiment the external air inlets 80*a* are provided in a rear part of the lower cover 8, the invention is not limited to this case; the external air inlets 80*a* may be provided at any positions in the lower cover 8.

Providing the above-described advantage that entrance of water into the engine cover can be prevented without affecting its appearance, the invention is particularly useful when applied to ventilation devices for ventilating an engine room.

Although the invention has been described above in relation to preferred embodiments and modifications thereof, it will be understood by those skilled in the art that other variations and modifications can be effected in these preferred embodiments without departing from the scope and spirit of the invention.

What is claimed is:

1. An outboard motor comprising: an engine cover comprising an upper cover and a lower cover which form an engine room and which can be separated from each other vertically, wherein:

the lower cover has a bottom wall and a circumferential wall which extends upward from an outer circumference of the bottom wall;

an external air inlet through which to introduce air into the engine room is provided adjacent to the outer circumference of the bottom wall; and an inside wall extends upward from the bottom wall alongside the circumferential wall so as to be opposed to the circumferential wall with the external air inlet interposed between the inside wall and the circumferential wall;

wherein a slant wall projects up outward from a top end of the inside wall so as to come closer to the associated side wall as the position goes up.

2. The outboard motor according to claim 1, wherein a projection wall projects downward from the bottom wall below the external air inlet.

3. The outboard motor according to claim 1, wherein the external air inlet is provided at a rear side of the bottom wall so as to extend alongside the circumferential wall.

4. The outboard motor according to claim 2, wherein the external air inlet is provided at a rear side of the bottom wall so as to extend alongside the circumferential wall.

5. The outboard motor according to claim 2, wherein the projection wall is part of a carrying handle that is disposed in the rear of the lower cover.

* * * * *